US006849318B1

(12) United States Patent
Davidson

(10) Patent No.: US 6,849,318 B1
(45) Date of Patent: Feb. 1, 2005

(54) METHOD FOR SECURING REBAR TOGETHER

(76) Inventor: Tommy Davidson, 1803 CR 2726, Caddo Mills, TX (US) 75135

( * ) Notice: Subject to any disclaimer, the term of this patent is extended or adjusted under 35 U.S.C. 154(b) by 0 days.

(21) Appl. No.: 10/794,139

(22) Filed: Mar. 5, 2004

Related U.S. Application Data

(62) Division of application No. 10/642,414, filed on Aug. 15, 2003.

(51) Int. Cl.[7] ..... B32B 31/04
(52) U.S. Cl. ..... 428/99; 52/686
(58) Field of Search ..... 428/99; 52/686, 52/687

(56) References Cited

U.S. PATENT DOCUMENTS 910,399 A * 1/1909 Lidseen ..... 52/686

* cited by examiner

*Primary Examiner*—Alexander S. Thomas
(74) *Attorney, Agent, or Firm*—Jack D. Stone, Jr.

(57) ABSTRACT

A method for preparing rebar for reinforcing concrete, wherein first and second receiver portions of an apparatus are engaged with a lower surface of a first rebar extending in a first direction. A semi-cylindrical portion of the apparatus are engaged with an upper surface of a second rebar extending in a second direction substantially orthogonal to the first direction, until the first rebar is urged against the second rebar.

16 Claims, 5 Drawing Sheets

METHOD FOR SECURING REBAR TOGETHER

CROSS-REFERENCE TO RELATED APPLICATION

This application is a divisional of, and hereby incorporates herein by reference, U.S. patent application Ser. No. 10/642,414, entitled "APPARATUS, AND ASSOCIATED METHOD, FOR SECURING REBAR TOGETHER", filed on Aug. 15, 2003.

TECHNICAL FIELD

The invention relates generally to rebar used for reinforcing concrete and, more particularly, to a method for elevating and securing rebar together to form a lattice for reinforcing concrete.

BACKGROUND

Conventionally, when concrete is to be poured, a form is first made to bound the concrete, and reinforcing bars ("rebar") are positioned to be embedded within the concrete after it is poured. The positioning of the rebar typically requires that the rebar be elevated and that rebars that cross other rebars be secured together where they cross to form a lattice. Typically, rebar is elevated using plastic supports, and is secured to other rebar by being manually tied together with wire. While such use of plastic supports and wire is effective, it is also time-consuming, and often results in inconsistent quality.

Therefore, what is needed is an apparatus and method for preparing rebar for use in concrete in a manner that is time-efficient and results in consistent quality.

SUMMARY

The present invention, accordingly, provides a method for preparing rebar for reinforcing concrete, wherein the first and second receiver portions of the apparatus are engaged with a lower surface of a first rebar extending in a first direction. The semi-cylindrical portion of the apparatus is then engaged with an upper surface of a second rebar extending in a second direction substantially orthogonal to the first direction, until the first rebar is urged against the second rebar.

By use of the present invention, rebar may be secured together and supported in an elevated position much more quickly than is possible using conventional techniques. Furthermore, the present invention facilitates consistently good, high-quality results.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

In the following discussion, numerous specific details are set forth to provide a thorough understanding of the present invention. However, it will be obvious to those skilled in the art that the present invention may be practiced without such specific details. Additionally, for the most part, details concerning rebar, how it is utilized in connection with concrete, and the like, have been omitted inasmuch as such details are not considered necessary to obtain a complete understanding of the present invention, and are considered to be within the skills of persons of ordinary skill in the relevant art.

Figure 1:
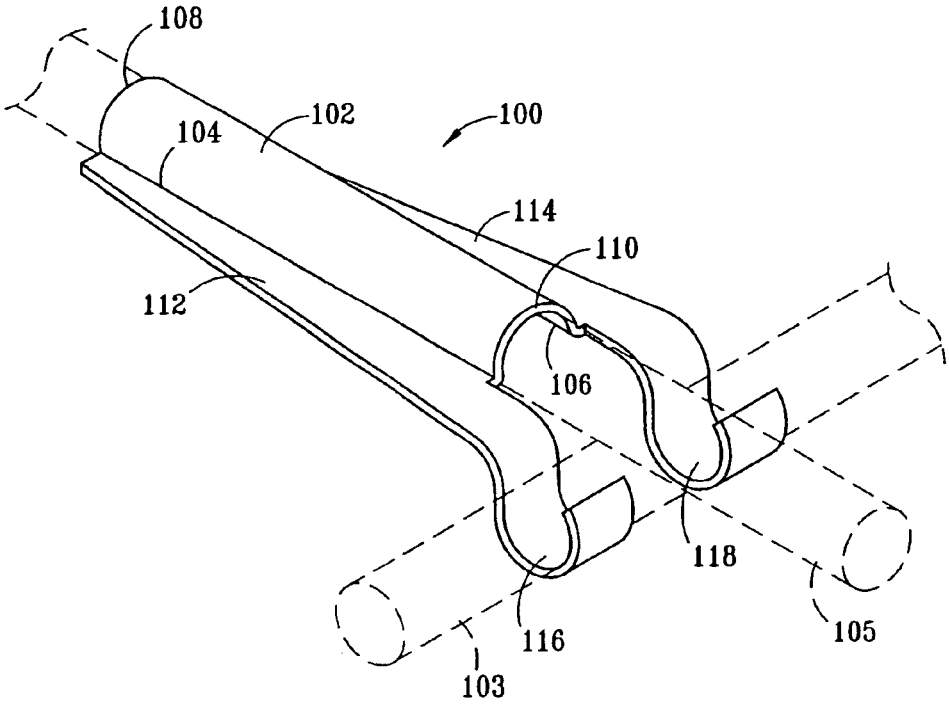
FIG. 1 is a perspective view of a rebar holder embodying features of the present invention for securing together two rebars, shown in dashed outline.

Referring to FIG. 1 of the drawings, the reference numeral 100 generally designates a rebar holder embodying features of the present invention. The holder 100 includes a semi-cylindrical portion 102 defining two opposing edges 104 and 106, and two opposing ends 106 and 110. Two flange portions 112 and 114 extend outwardly from the edges 104 and 106, respectively. Two preferably semi-circular receiver portions 116 and 118 extend longitudinally from the flanges 112 and 114, respectively, for receiving a rebar. The semi-circular receiver portions 116 and 118 are configured and sized for receiving a first rebar 103, shown in dashed outline. The semi-cylindrical portion 102 is configured and sized for receiving a second rebar 105, shown in dashed outline. The first rebar 103 and second rebar 105 preferably define approximately the same diameter, and are preferably oriented with respect to each other in a substantially orthogonal relationship.

The holder 100 is preferably fabricated as a single integrated unit from a material, such as, by way of example, plastic, acrylic, metal, a composite material, or the like, effective for facilitating ready manufacture thereof, while providing sufficient flexibility to receive and retain rebar. Accordingly, the inside diameter of the semi-cylindrical portion 102 and the semi-circular receiver portions 116 and 118 is preferably about the same, and is slightly less than (e.g., about 95% of) the outside diameter of the rebar to be retained by the holder 100, to thereby facilitate an interference fit between the rebar 103, 105 and the holder 100, and secure the holder to the rebar.

In the use and operation of the invention, a plurality of rebars, such as the rebars 103 and 105, are positioned to form a lattice configuration for reinforcing concrete (not shown). Then, as shown most clearly in FIG. 2, for each intersection formed by the rebar, the first and second receiver portions 116 and 118 of a holder 100 are preferably positioned to engage a lower surface (as viewed in FIG. 2) of the first rebar 103, extending in a first direction. The semi-cylindrical portion 102 of the holder 100 is then rotated downwardly in the direction of an arrow 204 into a position to engage with an upper surface of the second rebar 105, extending in a second direction, preferably, substantially orthogonal to the first direction. The semi-cylindrical portion 102 is thus rotated until the first rebar 103 is urged against the second rebar 105, thereby securing the first rebar 103 in position with respect to the second rebar 105.

Figure 2:
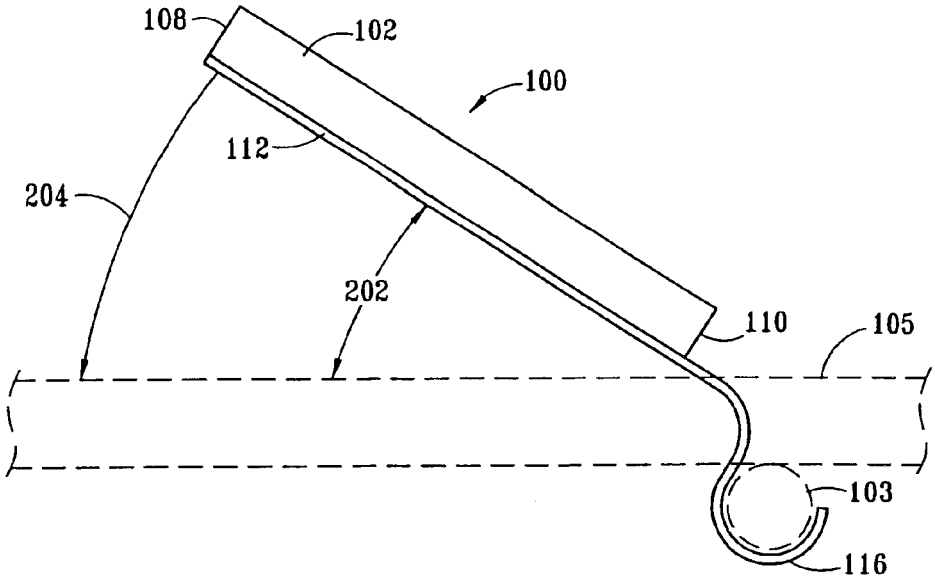
FIG. 2 is an elevation view of the rebar holder of FIG. 1 showing how the holder is rotated into position to secure rebar according to principles of the present invention.
Figure 3:
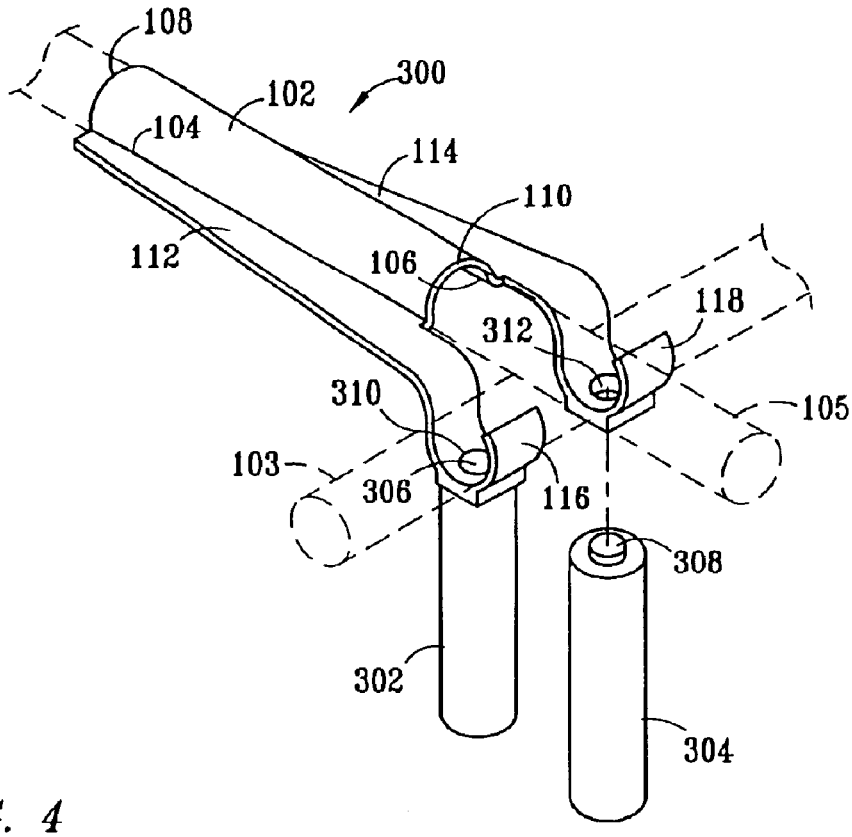
FIG. 3 is a perspective view of an alternate embodiment of the rebar holder of FIG. 2 adapted for receiving support legs.

FIG. 3 depicts an alternate embodiment 300 of the rebar holder of FIG. 2, which is adapted for receiving support legs 302 and 304, having nipples 306 and 308, respectively. The support legs 302 and 304 are preferably fabricated from the same material from which the holder 300 is fabricated (i.e., preferably the same material described above with respect to the holder 100 of FIG. 1). The receiver portions 116 and 118 of the holder 300 define openings 310 and 312, which are configured and sized for receiving the nipples 306 and 308. In operation, when the nipples 306 and 308 of the legs 302 and 304 are positioned in the respective openings 310 and 312, the holder 300 and rebar 103 and 105 supported thereby, may be suitably elevated for reinforcing concrete. Operation of the holder 300 is otherwise similar to that described above with respect to FIGS. 1 and 2.

Figure 4:
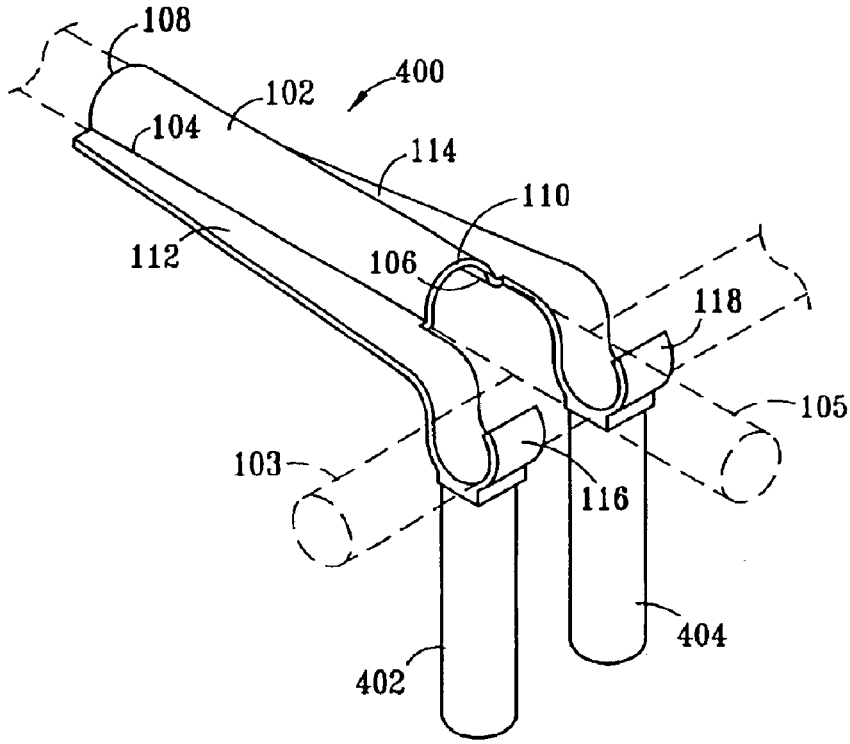
FIG. 4 is a perspective view of an alternate embodiment of the rebar holder of FIG. 2 wherein support legs extend from the holder.

FIG. 4 shows an alternate embodiment 400 of the rebar holder of FIG. 2, wherein support legs 402 and 404 extend from the receiver portions 116 and 118 of the holder 400. The holder 400 and operation thereof is substantively similar to that of the holder 300 described above with respect to FIG. 3, but for the legs 402 and 404, which are integrally formed with the holder 400.

Figure 5:
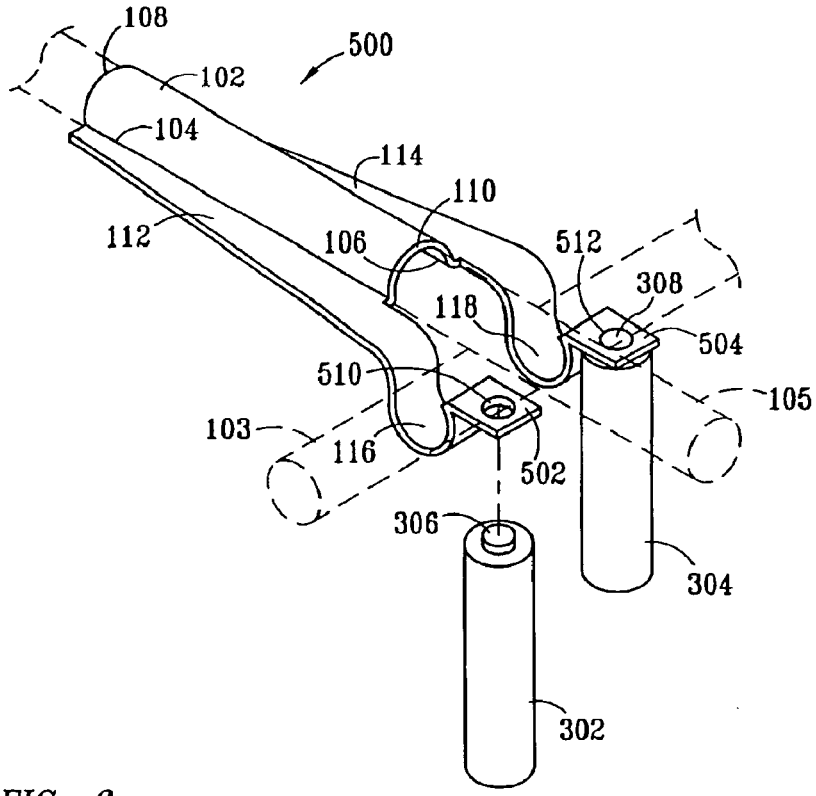
FIG. 5 is a perspective view of an alternate embodiment of the rebar holder of FIG. 3 configured with lips for receiving legs for supporting the holder.

FIG. 5 depicts an alternate embodiment 500 of the rebar holder 300 of FIG. 3. The holder 500 is similar to the holder 300, but for the addition of lips 502 and 504, which extend longitudinally from the receiver portions 116 and 118. The lips 502 and 504 define openings 510 and 512, similar to the openings 310 and 312 (FIG. 3), configured for receiving nipples 306 and 308 of the legs 302 and 304. But for the positioning of the legs 302 and 304 with respect to the holder 500, operation of the holder 500 is substantively similar to the operation of the holder 300. It is noted that an advantage of positioning the legs 502 and 504 to the holder 500 over the legs 302 and 304 to the holder 300 is that, with respect to the former, the legs 502 and 504 utilize leverage to more effectively secure the holder 500 to the rebar 105.

Figure 6:
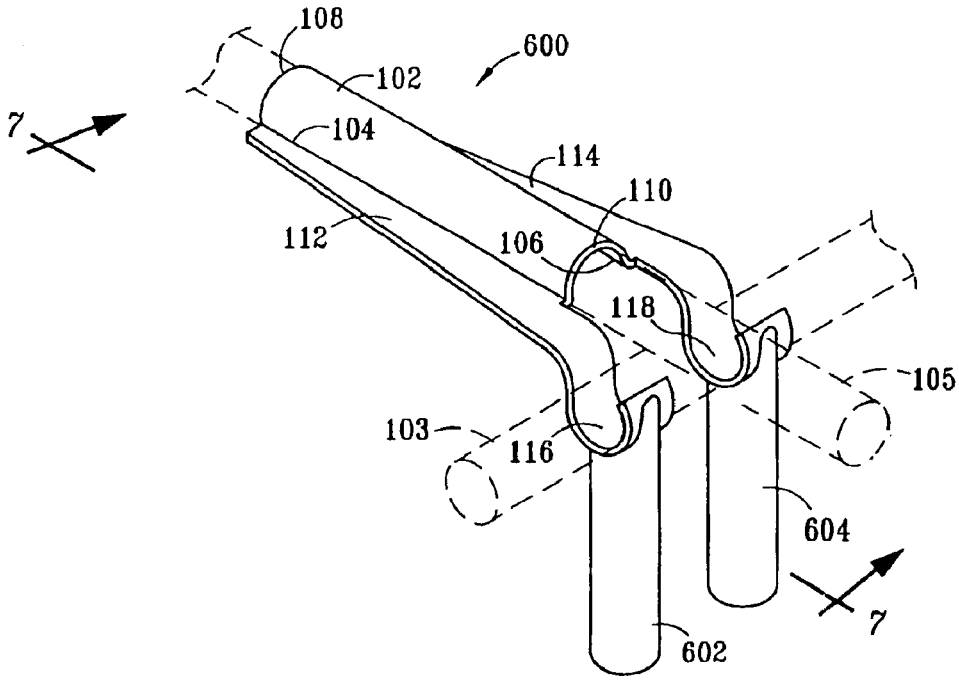
FIG. 6 is a perspective view of an alternate embodiment of the rebar holder of FIG. 2, wherein support legs extend from the holder.
Figure 7:
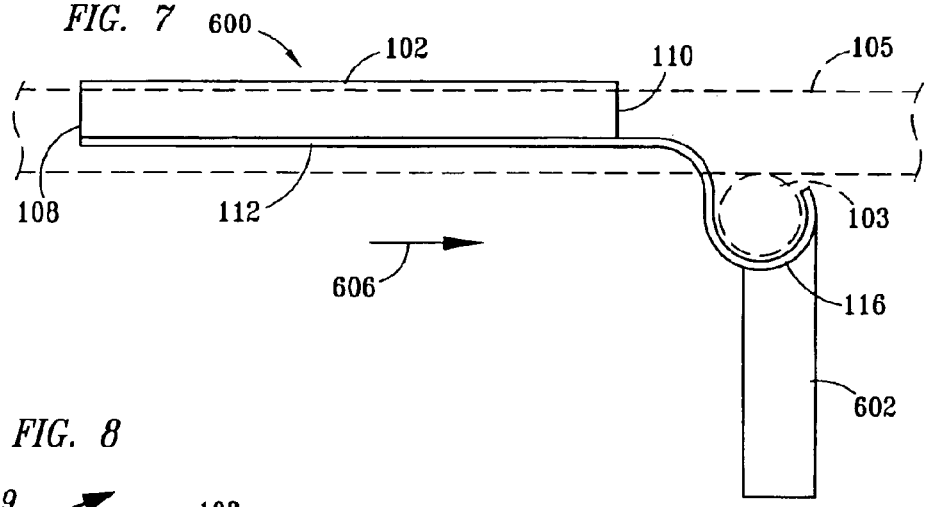
FIG. 7 is a cross-section view of the rebar holder of FIG. 6 taken along the line 7—7 of FIG. 6.

FIG. 6 depicts an alternate embodiment 600 of the rebar holder 400 of FIG. 4. The holder 600 is similar to the holder 400, but for the position of the legs 602 and 604, which, as most clearly shown in FIG. 7, are positioned forward (i.e., in the direction of the arrow 606) along the receiver portions 116 and 118. But for the positioning of the legs 602 and 604 with respect to the holder 600, operation of the holder 600 is substantively similar to the operation of the holder 400. It is noted that an advantage of positioning the legs 602 and 604 to the holder 600 over the legs 402 and 404 to the holder 400 is that, with respect to the former, the legs 602 and 604 utilize leverage to more effectively secure the holder 600 to the rebar 105.

Figure 8:
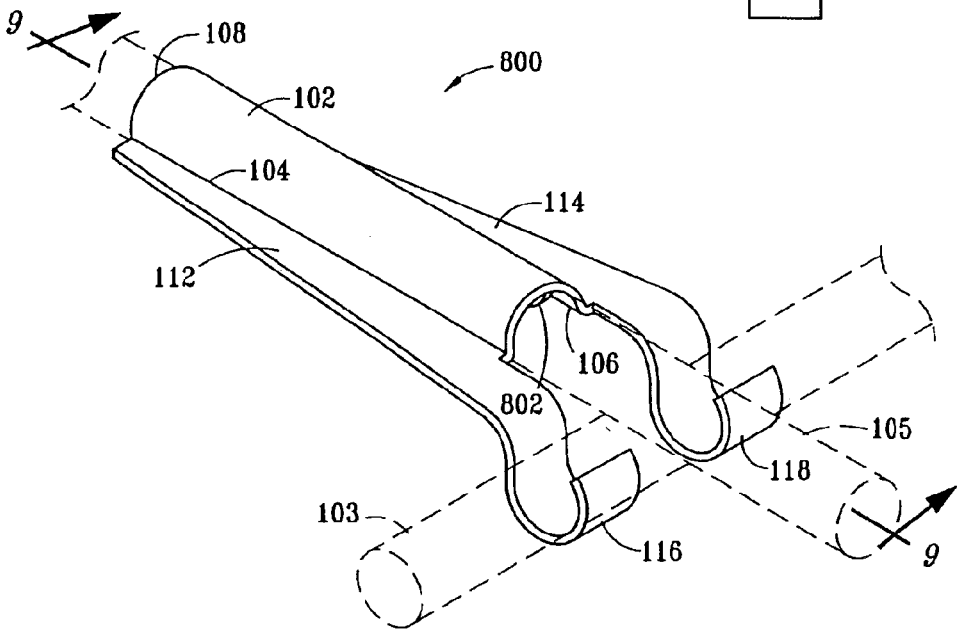
FIG. 8 is a perspective view of an alternate embodiment of the rebar holder of FIG. 1, wherein a cam is formed on an interior surface of the holder for securing the holder in place on the rebar.
Figure 9:
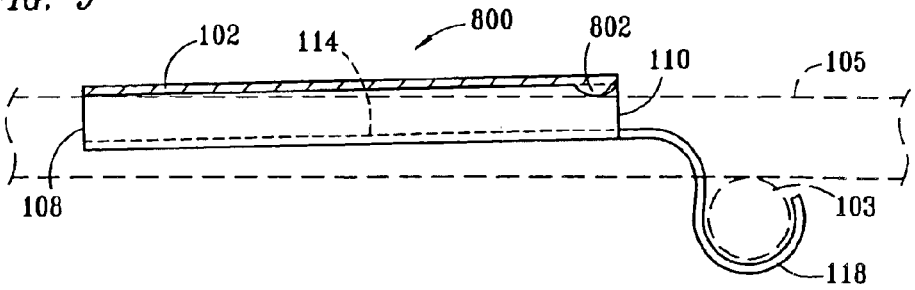
FIG. 9 is a cross-sectional view of the rebar holder of FIG. 8 taken along the line 9—9 of FIG. 8.

FIG. 8 is a perspective view of an alternate embodiment 800 of the rebar holder 100 of FIG. 1, wherein a cam 802 is formed on an interior surface of the semi-cylindrical portion 102 of the holder 800 for further securing the holder 800 in place on the rebar 103 and 105. Specifically, the cam 802 is preferably formed on the interior surface of the semi-cylindrical portion 102 approximately centrally between the edges 104 and 106 and, as shown most clearly in FIG. 9, preferably adjacent to the end 110. The cam 802 is preferably shaped in accordance with conventional design principles so that the force required to effectuate rotation of the semi-cylindrical portion 102 from an angle 202 (FIG. 2) of 90° to an angle 202 of 0° is met with greatest resistance just before reaching an angle 202 of 0°. For example, the aforementioned resistance should be greatest when the angle 202 is between about 5° and about 45°, and preferably when the angle 202 is between about 10° and about 30°. In operation, when the semi-cylindrical portion 102 is rotated downwardly to engage the second rebar 105, the cam 802 alters the pivot point, so that at an angle 202 of preferably about 10° to about 30°, additional resistance is encountered just before the second rebar 105 engages the second rebar 105 at an angle 202 of 0°. The additional resistance, however, is relieved once the semi-cylindrical portion 102 fully engages the second rebar 105. The cam 802 action resulting in the additional resistance at an angle 202 of about 10° also acts to inhibit the holder 800 from becoming disengaged from the rebar 105, thereby further securing the holder 800 to the rebar 103 and 105. Operation of the holder 800 is otherwise similar to the operation of the holder 100 described above with respect to FIGS. 1 and 2.

Figure 10:
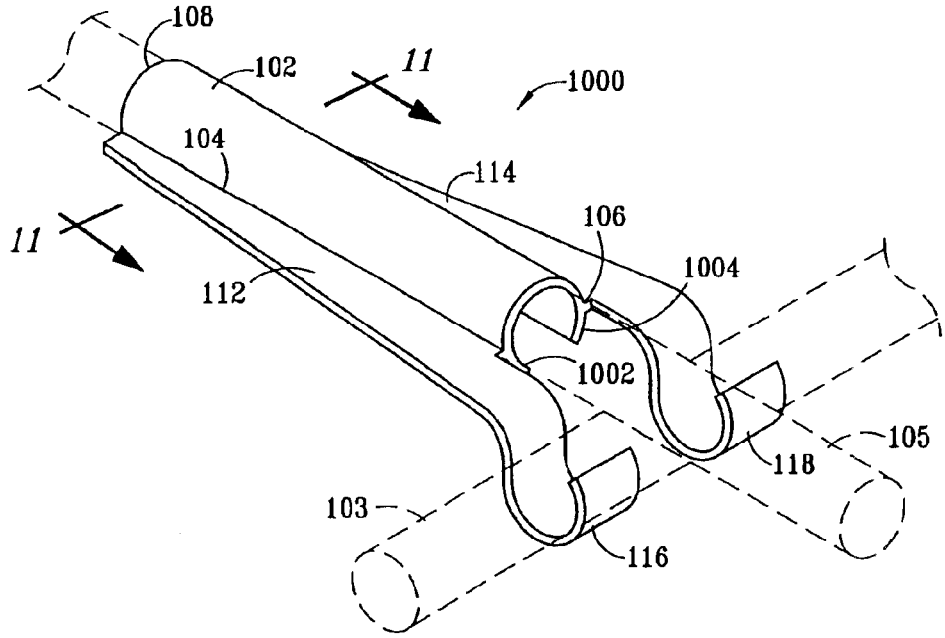
FIG. 10 is a perspective view of an alternate embodiment of the rebar holder of FIG. 1, wherein a cylindrical portion of the holder is extended.
Figure 11:
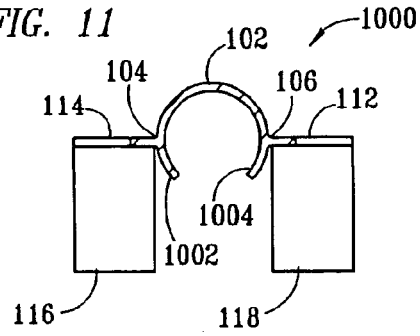
FIG. 11 is a cross-sectional view of the rebar holder of FIG. 10 taken along the line 11—11 of FIG. 10.

FIG. 10 is a perspective view of an alternate embodiment 1000 of the rebar holder 100 of FIG. 1, wherein the cylindrical portion 100 of the holder 1000 is extended beyond the edges 106 and 104. As shown most clearly in FIG. 11, the cylindrical portion 102 includes extended portions 1002 and 1004 which extend about 5° to about 30°, and preferably about 10° to about 15°, below (as viewed in FIG. 11) the respective edges 106 and 104. Operation of the holder 1000 is similar to operation of the holder 100, but during the process of engagement of the semi-cylindrical portion 102 with the rebar 105, the extended portions 1002 and 1004 flex open, and then upon completion of engagement (FIG. 10), the extended portions 1002 and 1004 effect a clamping action to further secure the holder 1000 to the rebar 105.

By use of the present invention, rebar may be secured together to form a lattice, and supported in an elevated position much more quickly than is possible using conventional techniques comprising, for example, wire. Furthermore, the present invention facilitates consistently good, high-quality results.

It is understood that the present invention may take many forms and embodiments. Accordingly, several variations may be made in the foregoing without departing from the spirit or the scope of the invention. For example, an upper portion of the semi-cylindrical portion 102 may be opened between the ends 108 and 110 to conserve materials and allow concrete to bond directly to rebar. The receiver portions 116 and 118 may be designed to allow for rebar that is not orthogonal; for example, the receiver portions may be configured to allow for rebar that is oriented 70° or 80° relative another rebar, rather than in a 90° relationship constituting an orthogonal relationship. Furthermore, aspects of the invention such as depicted by the legs (FIGS. 3–7), cam (FIGS. 8 and 9), and extended cylindrical portion (FIGS. 10 and 11), may be combined in any number of different ways as desired. For example, the legs 302 and 304 of FIG. 3 may be combined with the cam 802 of FIG. 8, or the cam 804 may be combined with the extended semi-cylindrical portions 1002 and 1004, or the legs 602 and 604 may be combined with the extended semi-cylindrical portions 1002 and 1004 and cam 802. Still further, the invention described herein is not limited to use with rebars, but may be adapted for use with any type of bars, rods, and the like, that may be used in applications related to concrete or other applications that utilize bars, rebar, rods, and the like. Still further, the semi-circular cross-sections of the semi-cylindrical portion 102 and the two opposing semi-circular ends 108 and 110, may include cross-sections that are semi-elliptical, or may be defined by a plurality of concatenated flat sides, such as three flat sides, five flat sides, or ten flat sides, or a combination of a number of flat sides and semi-circular and/or semi-elliptical cross-sections.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A method for preparing rebar for reinforcing concrete, the method comprising:

engaging first and second receiver portions of an apparatus with a lower surface of a first rebar extending in a first direction; and rotating said apparatus about said first rebar until a semi-cylindrical portion of said apparatus engages with an upper surface of a second rebar extending in a second direction substantially orthogonal to said first direction, and said first rebar is urged against said second rebar.

2. The method of claim 1 further comprising providing first and second legs extending from said respective first and second receiver portions, said first and second legs being configured for supporting in an elevated position said apparatus and said rebar secured by said apparatus.

3. The method of claim 1 wherein said first and second receiver portions are configured for receiving respective first and second legs for supporting in an elevated position said apparatus and said rebar secured by said apparatus.

4. The method of claim 1 further comprising first and second lips extending longitudinally from said respective first and second receiver portions; and first and second legs extending from said respective first and second lips for supporting in an elevated position said apparatus and said rebar secured by said apparatus.

5. The method of claim 1, wherein said apparatus further comprises first and second lips extending longitudinally from said respective first and second receiver portions, said first and second lips being configured for receiving a respective first and second leg for supporting in an elevated position said apparatus and said rebar secured by said apparatus.

6. The method of claim 1, wherein said apparatus is fabricated from at least one of plastic, acrylic, nylon, and metal.

7. The method of claim 1, wherein said semi-cylindrical portion extends through an arc of substantially 180°.

8. The method of claim 1, wherein said semi-cylindrical portion further comprises two extended portions which, together with the semi-cylindrical portion, define an arc exceeding 180°.

9. The method of claim 1, wherein said apparatus further comprises a cam portion formed on an interior surface of said semi-cylindrical portion, adjacent to one of said ends most proximate to said first and second receiver portions.

10. A method for preparing rebar for reinforcing concrete, the method comprising:

engaging first and second receiver portions of an apparatus with a lower surface of a first rebar extending in a first direction; and rotating said apparatus about said first rebar until a third receiver portion of said apparatus engages with an upper surface of a second rebar extending in a second direction substantially orthogonal to said first direction, and said first rebar is urged against said second rebar.

11. The method of claim 10 further comprising providing first and second legs extending from said respective first and second receiver portions, said first and second legs being configured for supporting in an elevated position said apparatus and said rebar secured by said apparatus.

12. The method of claim 10 wherein said first and second receiver portions are configured for receiving respective first and second legs for supporting in an elevated position said apparatus and said rebar secured by said apparatus.

13. The method of claim 10 further comprising first and second lips extending longitudinally from said respective first and second receiver portions; and first and second legs extending from said respective first and second lips for supporting in an elevated position said apparatus and said rebar secured by said apparatus.

14. The method of claim 10, wherein said apparatus further comprises first and second lips extending longitudinally from said respective first and second receiver portions, said first and second lips being configured for receiving a respective first and second leg for supporting in an elevated position said apparatus and said rebar secured by said apparatus.

15. The method of claim 10, wherein said apparatus is fabricated from at least one of plastic, acrylic, nylon, and metal.

16. The method of claim 10, wherein said apparatus further comprises a cam portion formed on an interior surface of said third portion, adjacent to one of said ends most proximate to said first and second receiver portions.

* * * * *